US007562634B2

(12) United States Patent
Shu

(10) Patent No.: US 7,562,634 B2
(45) Date of Patent: Jul. 21, 2009

(54) DIVING DEVICE

(75) Inventor: Ching-Min Shu, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/749,754

(22) Filed: May 17, 2007

(65) Prior Publication Data

US 2008/0053359 A1 Mar. 6, 2008

Related U.S. Application Data

(60) Provisional application No. 60/823,800, filed on Aug. 29, 2006.

(51) Int. Cl.
*B63G 8/00* (2006.01)
*B63G 8/08* (2006.01)

(52) U.S. Cl. ..... 114/312; 114/338

(58) Field of Classification Search ..... 114/312, 114/338

See application file for complete search history.

(56) References Cited

U.S. PATENT DOCUMENTS 5,477,674 A * 12/1995 Somers et al. ..... 60/415
5,522,337 A * 6/1996 Meyers et al. ..... 114/312
6,698,373 B2 * 3/2004 Geriene et al. ..... 114/244
7,051,664 B2 * 5/2006 Robichaud et al. ..... 114/312

FOREIGN PATENT DOCUMENTS

CN 1515460 7/2004

* cited by examiner

*Primary Examiner*—Jesus D Sotelo
(74) *Attorney, Agent, or Firm*—Jianq Chyun IP Office

(57) ABSTRACT

A diving device is provided herein. The diving device includes a sealed main body and an actuator. The sealed main body has a flexible portion disposed on one part of the sealed main body. The flexible portion is controlled by the actuator to change the volume of the diving device. Therefore, a force is generated to drive the diving device moving upward or downward.

7 Claims, 5 Drawing Sheets

DIVING DEVICE

CROSS-REFERENCE TO RELATED APPLICATION

This application claims the benefit of U.S. Provisional Application No. 60/823,800, filed on Aug. 29, 2006, entitled "DIVING DEVICE." The entirety of the above-mentioned patent application is hereby incorporated by reference herein and made a part of this specification.

BACKGROUND OF THE INVENTION

1. Field of Invention

The present invention relates to a diving device, and more particularly, to a diving device that moves by changing the volume of the diving device.

2. Description of Related Art

The diving principle of the conventional diving device is to intake water into a sealed main body to add the weight, so as to drive the device to dive downwards. On the contrary, the water of the main body is drained to lighten the weight, so as to drive the device to float upwards. Usually, the intake and draining of water for the sealed main body is achieved by utilizing a servo motor to drive a piston shaped like a syringe to move back and forth. Therefore, the conventional diving device is complex and high cost.

SUMMARY OF THE INVENTION

The present invention provides a diving device with a low cost and a simple structure. The diving device includes a scaled main body and an actuator. The sealed main body has a flexible portion, such as a membrane, disposed on one part of the sealed main body. The actuator is connected to the flexible portion and pulls or pushes the flexible portion so as to change the volume of the diving device. Therefore, according to the density difference between the diving device and the material encompassing it, the diving device moves upwards or downwards in the environment.

In one embodiment, the present invention provides a diving device with a collision avoidance system for avoiding collision not only between the diving device and any other subjects in the environment but also between the diving device and boundaries of the environment in different directions. If the collision avoidance system senses that the vertical distance between the diving device and any other subject or the boundaries of the environment is smaller than a predetermined value, the flexible portion is pulled or pushed by the actuator to change volume of the diving device, whereby the density of the diving device is changed. Therefore the diving device moves upward or downwards to avoid collision in the vertical direction.

In another embodiment, the main body has a plurality of flexible portions disposed on a plurality of parts of the sealed main body. The actuator is connected to the flexible portions. The flexible portions are respectively controlled by the actuator to change the volume of the diving device.

In the diving device mentioned above, the collision avoidance system further includes a plurality of sensors for sensing the distance variations in both vertical and horizontal directions. If the sensed distance in the vertical direction is smaller than a first predetermined value, the flexible portion is pulled or pushed by the actuator to change the volume of the diving device, whereby the density of the diving device is changed. Therefore the diving device moves upward or downwards to avoid collision in the vertical direction.

The collision avoidance system mentioned above further includes a left driving assembly and a right driving assembly. If the sensed distance in the horizontal direction is smaller than a second predetermined value, the left driving assembly and right driving assembly can provide power to drive the diving device moving leftward or rightward to avoid collision in the horizontal direction.

In order to make the aforementioned and other objectives, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
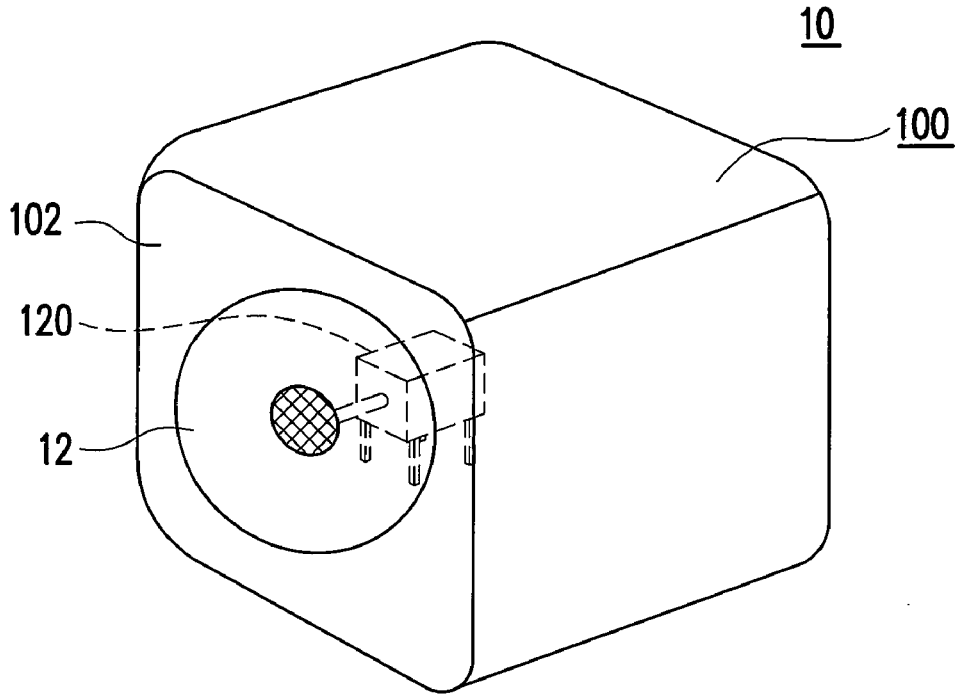
FIG. 1A is a schematic diagram of a diving device of a preferred embodiment of the present invention.

The present invention provides a diving device. The diving device includes a sealed main body and an actuator. The sealed main body has a flexible portion, such as a membrane, disposed on one part of the sealed main body, for example, if the sealed main body is a cubic shape, the flexible portion can be disposed on one side of the sealed main body. The actuator is connected to the flexible portion and pulls or pushes the flexible portion so as to change the volume of the diving device. Therefore, according to the density difference between the diving device and the material encompassing it, the diving device moves upwards or downwards in the environment.

In the diving device above, the vertical movement of the diving device can be achieved by changing the volume of the diving device, whereby changing the density of the diving device. The diving device includes a sealed main body with a flexible portion such as a membrane disposed on one part of the main body. The sealed main body can be made of rigid material or any other materials. The flexible portion can be, for example, an elastic silica gel.

When the flexible portion is pushed to expand outwards, the volume of the main body is increased accordingly; thereby the whole density of the diving device is decreased. Once the whole density of the diving device is lower than the density of the liquid or water where the diving device is encompassed, an upward buoyancy force is generated to drive the diving device to move upwards. On the contrary, when the flexible portion is pulled to sink inwards, the volume of the main body is decreased accordingly, and thereby the whole density of the diving device is increased. Once the whole density of the diving device is higher than the density of the liquid or water where the diving device is encompassed, a downward buoyancy force is generated to drive the diving device to move downwards. If the flexible portion is pushed and pulled outwards and inwards regularly, the diving device can float upward and sink downward regularly and smoothly in the environment.

In one embodiment, the invention provides a diving device, in which the density of the diving device is designed to be sufficiently close to the density of the materials encompassing the diving device. Such configuration makes the diving device being able to be floating in any position of the environment. The diving device of the present invention can move in any direction smoothly in the ocean, in an aquarium, a liquid container, a pond, a pool or the like. Similarly, while the flexible portion is pushed and pulled outwards and inwards regularly, the diving device can float upward and sink downward regularly and smoothly in the environment.

In the diving device, a collision avoidance system is provided inside the sealed main body to prevent collision. The collision avoidance system is used for avoid collision not only between the diving device and any other subjects in the environment but also between the diving device and boundaries of the environment. If the collision avoidance system senses that the vertical distance between the diving device and any other subject or the boundaries of the environment is smaller than a predetermined value, the actuator inside is actuated and the flexible portion is pulled or pushed by the actuator to change volume of the diving device, whereby the density of the diving device is changed. Therefore the diving device moves upward or downwards to avoid collision in the vertical direction.

One or a plurality of sensors and a driving device are provided in the collision avoidance system. For example, if a vertical distance between the diving device and any other subject or the boundary of the environment sensed by the sensor is smaller than a predetermined value, the actuator inside is actuated in response to the sense results and the flexible portion is controlled by the actuator to change volume of the diving device, in order to respectively change the position of the diving device to increase the distance so as to avoid collision in the vertical direction. The sensors in the collision avoidance system can be an ultrasonic distance sensors or the like.

The collision avoidance system further includes a pair of driving assemblies for providing forward, backward, leftward and rightward moving forces. The pair of the driving assemblies are referenced as a left driving assembly and a right driving assembly disposed symmetrically on one side of the diving device to provide the forward, backward, leftward and rightward moving forces. The left driving assembly includes a left propeller and a left driving unit for driving the left propeller. The right driving assembly includes a right propeller and a right driving unit for driving the right propeller. By optionally activating the left driving assembly and/or the right driving assembly, the forward, backward, leftward and rightward moving forces are generated, whereby the diving device can move forward, backward, leftward or rightward to change the moving direction.

Figure 1B:
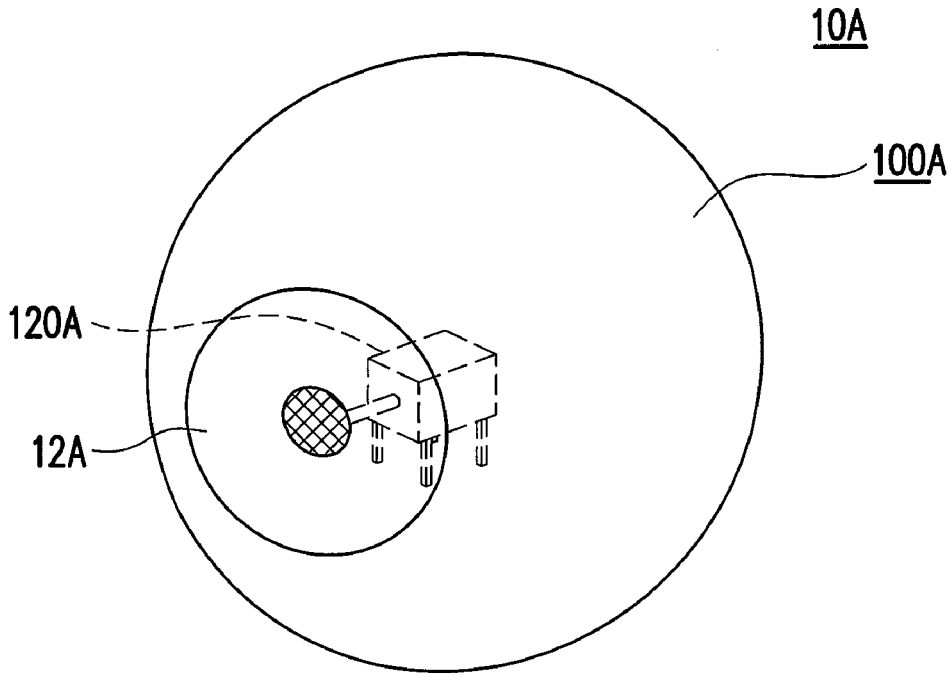
FIG. 1B is a schematic diagram of a diving device of another embodiment of the present invention.

For explanation, a schematic diagram of a diving device of an embodiment of the invention is shown in FIG. 1A. The diving device is moving in an aquarium, for example. FIG. 1A shows a lateral view of the diving device 10, which includes a sealed main body 100 with a flexible portion 12 at one part 102 of the main body 100, and an actuator 120 inside the main body 100. The actuator 120 is connected to the flexible portion 12 and pulls or pushes the flexible portion 12 so as to change the volume of the diving device. Therefore, according to the density difference between the diving device 10 and the material encompassing it, the diving device 10 moves upwards or downwards in the environment. Another embodiment is provided in FIG. 1B, which shows a schematic diagram of a diving device. In the diving device 10A, the shape of the main body 100A is spherical, and a flexible portion 12A is disposed at one part of the main body 100A. An actuator 120A is provided inside the main body 100A for pulling or pushing the flexible portion 12A.

Figure 2A:
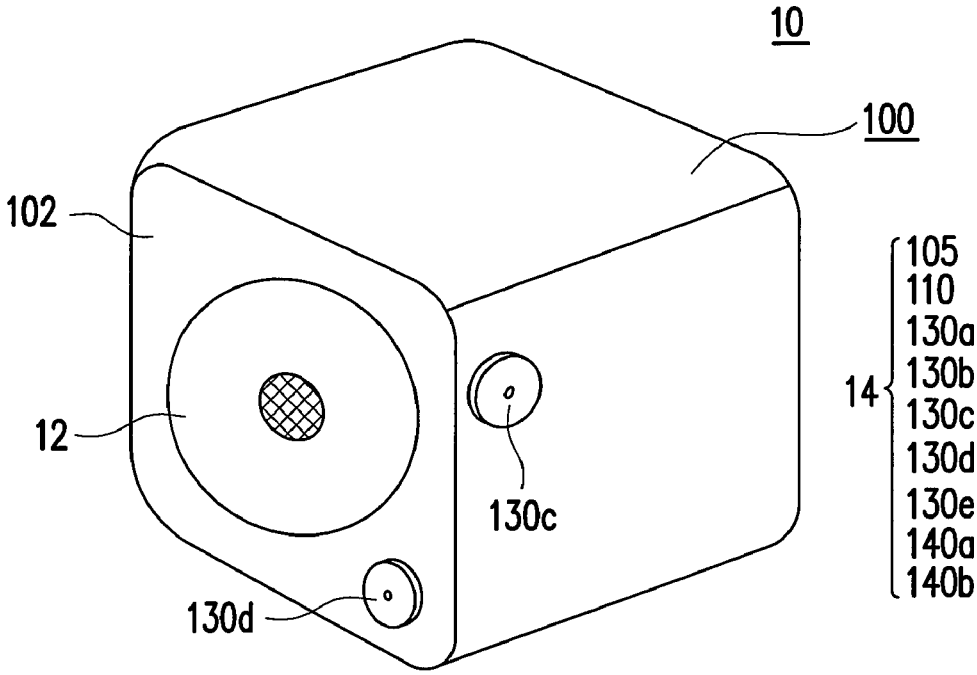
FIGS. 2A, 2B and 2C are schematic diagrams of a diving device of another embodiment of the present invention.
Figure 2B:
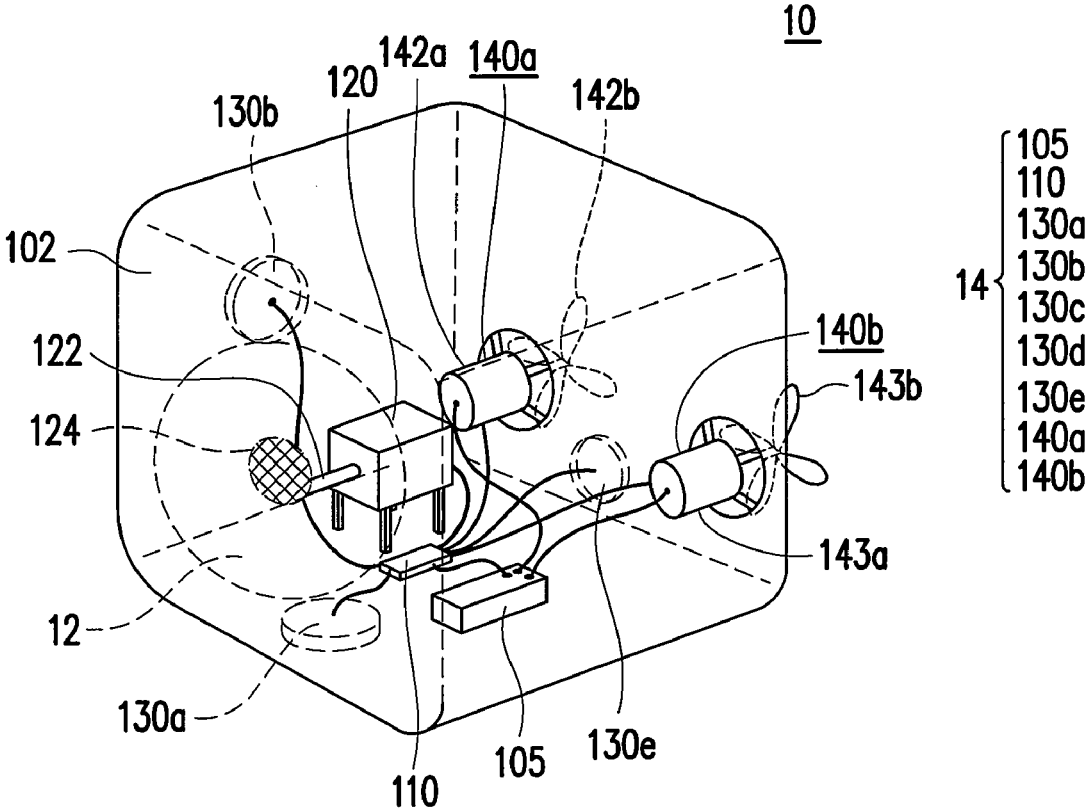
Figure 2C:
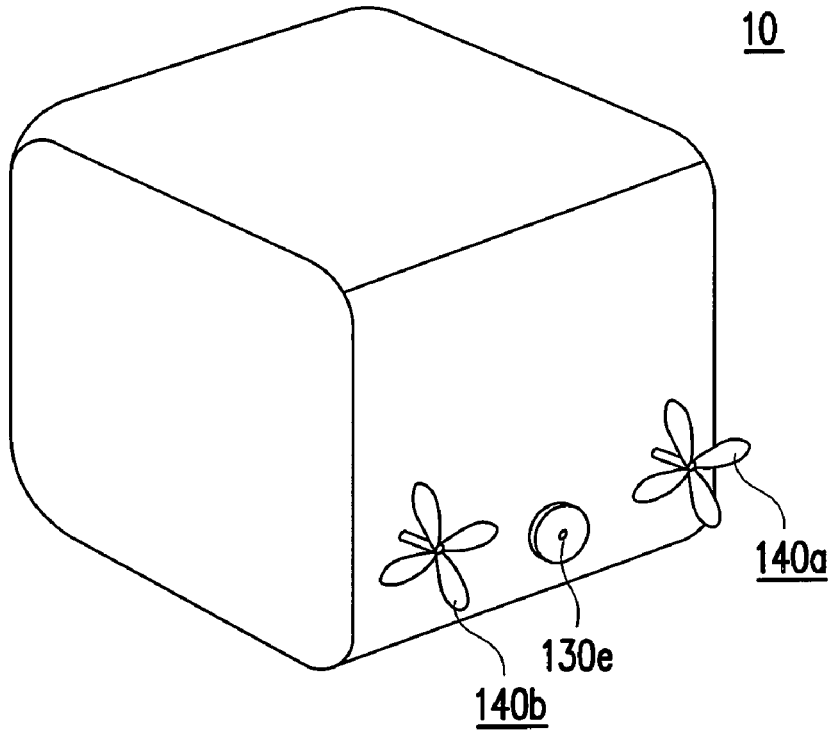

For further explanation, schematic diagrams of a diving device of another 1 preferred embodiment of the present invention are shown in FIG. 2A, FIG. 2B and FIG. 2C. The diving device is moving in an aquarium, for example. FIG. 2A shows a lateral view of the diving device 10, FIG. 2B and FIG. 2C show perspective views of the diving device 10. The diving device 10 includes a sealed main body 100 with a flexible portion 12 at one part 102 of the main body 100, an actuator 120 inside the main body 100, and a collision avoidance system 14. The collision avoidance system 14 includes a microprocessor 110, and a power supply 105, all of which are disposed in the main body 100. The collision avoidance system 14 further includes one or a plurality of distance sensors, for example, a vertical distance sensor 130*a*, a pair of horizontal distance sensors 130*b* and 130*c*, a front distance sensor 130*d* and a rear distance sensor 130*e*, which are respectively disposed on different sides of the main body 100

The collision avoidance system 14 further includes a left driving assembly 140*a* and a right driving assembly 140*b*, each of which respectively includes, for example, a motor and a propeller driven by the motor. The motors of the driving assemblies 140*a* and 140*b* are disposed in the main body 100 and the propellers of the driving assemblies 140*a* and 140*b* are disposed on one exterior side of the main body 100, as shown in FIGS. 2B and 2C. By optionally activating the left driving assembly 140*a* and/or the right driving assembly 140*b*, the forward, backward, leftward and rightward moving forces are generated, whereby the diving device 10 can move forward, backward, leftward or rightward to change the moving direction.

As shown in FIG. 2B, the actuator 120, vertical distance sensor 130*a*, horizontal distance sensors 130*b* and 130*c*, front distance sensor 130*d* and rear distance sensor 130*e* and driving assemblies 140*a* and 140*b* are controlled by the microprocessor 110. The actuator 120 is, for example, a servo motor, and is connected to the flexible portion 12 through a transmission shaft 122 and a connecting part 124.

By using the vertical distance sensor 130*a*, if a distance in a vertical direction between the diving device 10 and any other subject or the boundary is sensed to be smaller than a predetermined value, the flexible portion 12 is pushed and pulled by the actuator 120 to change volume of the diving device 10, in order to change the position of the diving device 10 to avoid collision in the vertical direction.

Figure 3A:
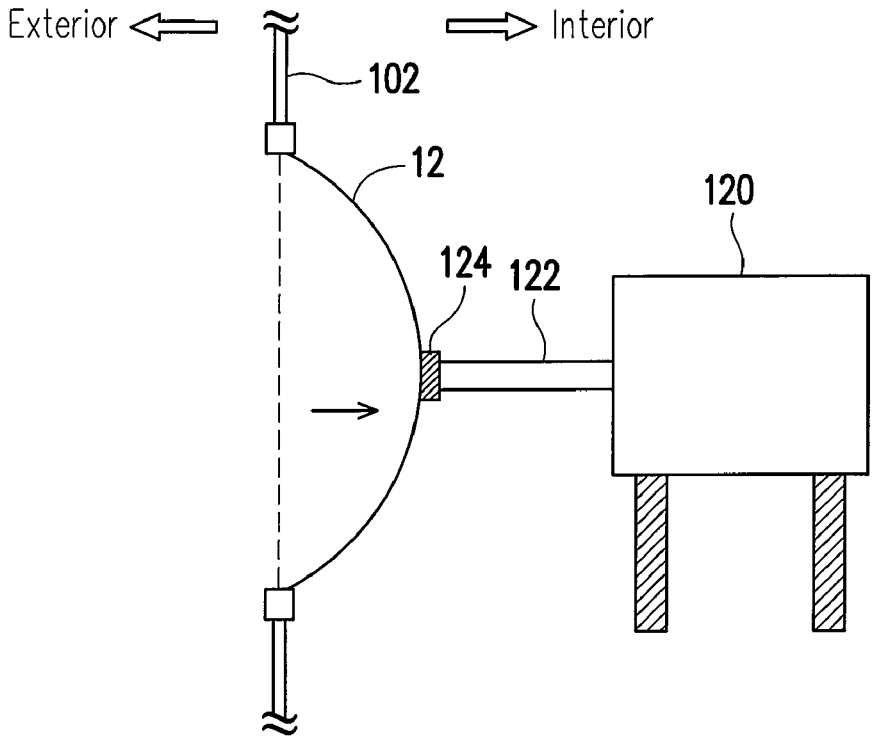
FIGS. 3A and 3B are schematic diagrams showing the actuator pulling and pushing the flexible portion.

For example, when the vertical distance sensor 130*a* detects that a distance between the diving device 10 and the ground of the aquarium is larger than a predetermined value, the detecting result will be forwarded to the microprocessor 110. The microprocessor 110 will control the actuator 120 to pull the flexible portion 12 to sink inwards, to an interior direction as shown in FIG. 3A, the volume of the diving device 10 is decreased accordingly, and thereby the whole density of the diving device 10 is increased and a downward buoyancy force is generated to drive the diving device 10 to move downwards.

Figure 3B:
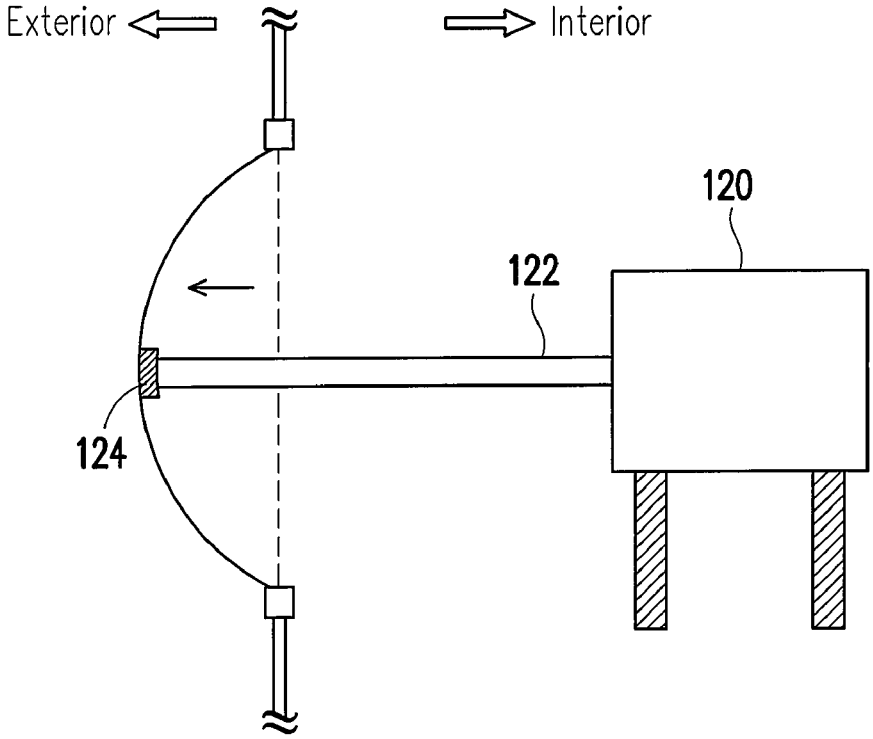

On the contrary, when the vertical distance sensor 130*a* detects that a distance between the diving device 10 and the ground of the aquarium is smaller than a predetermined value, the detecting result will be forwarded to the microprocessor 110. The microprocessor 110 will control the actuator 120 to push the flexible portion 12 to expand outwards, to an exterior direction as shown in FIG. 3B, the volume of the diving device 10 is increased accordingly, and thereby the whole density of the diving device 10 is decreased and an upward buoyancy force is generated to drive the diving device to move upwards so as to prevent collision. In another example, when the horizontal distance sensors 130*b* or 130*c* detects that a distance in a horizontal direction between the diving device and any subject or the horizontal boundaries of the aquarium is smaller than a predetermined value, the detecting result will be forwarded to the microprocessor 110. The microprocessor 110 will respectively control the left driving and right driving assemblies 140*a* and 140*b* to provide power to drive the diving device moving leftward or rightward in response to the sensing result from the horizontal distance sensors 130*b* and 130*c*. The left driving assembly 140*a* includes a motor 142*a* and a propeller 142*b* driven by the motor 142*a*. The right driving assembly 140*b* includes a motor 143*a* and a propeller 143*b* driven by the motor 143*a*. The motors 142*a* and 143*a* are disposed in the main body 100 and the propellers 142*b* and 143*b* are symmetrically disposed in a left part and a right part of the same side of the main body 100.

When the front distance sensor 130*d* or the rear distance sensor 130*e* detects that a distance in the front or in the rear direction between the diving device 10 and any subject or the boundaries of the aquarium is smaller than a predetermined value, the detecting result will be forwarded to the microprocessor 110. The microprocessor 110 will respectively control the left driving and right driving assemblies 140*a* and 140*b* to provide power to drive the diving device moving backward or forward in response to the sensing result from the front distance sensor 130*d* and rear distance sensor 130*e*. For example, by activating the propeller 142*b* and 143*b* for a clockwise rotation at the same time, a power to move the diving device 10 forward is generated, and, on the contrary, if the propeller 142*b* and 143*b* are activated for a counterclockwise rotation at the same time, a power to move the diving device 10 backward is generated.

Figure 2D:
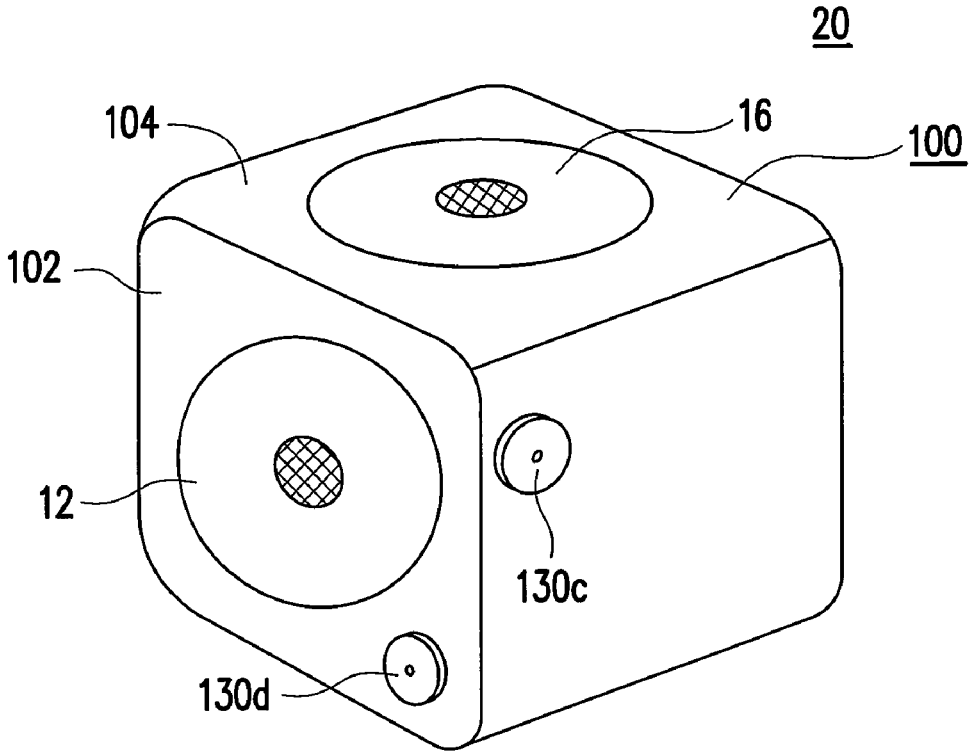
FIG. 2D is a schematic diagram of a diving device of a further embodiment of the present invention.

In another embodiment, refer to FIG. 2D, which shows a schematic diagram of a diving device of another embodiment of the present invention. The diving device 20 is similar to the diving device 10 as shown in FIGS. 2A~2C except that the diving device 20 includes a sealed main body 100 with two flexible portions 12 and 16 respectively disposed on one part 102 and the other part 104 of the main body 100. The microprocessor 110 controls the actuator 120 to pull the flexible portions 12 or/and 16 to sink inwards, and the volume of the diving device 20 is decreased accordingly, and thereby the whole density of the diving device 20 is increased and a downward buoyancy force is generated to drive the diving device to move downwards. The microprocessor 110 controls the actuator 120 to push the flexible portions 12 or/and 16 to expand outwards, the volume of the diving device 20 is increased accordingly, and thereby the whole density of the diving device 20 is decreased and an upward buoyancy force is generated to drive the diving device to move upwards. It is known that more than two membranes can also be provided for the diving device 20 to generate an upward or downward buoyancy forces more efficiently, if desired.

Figure 2E:
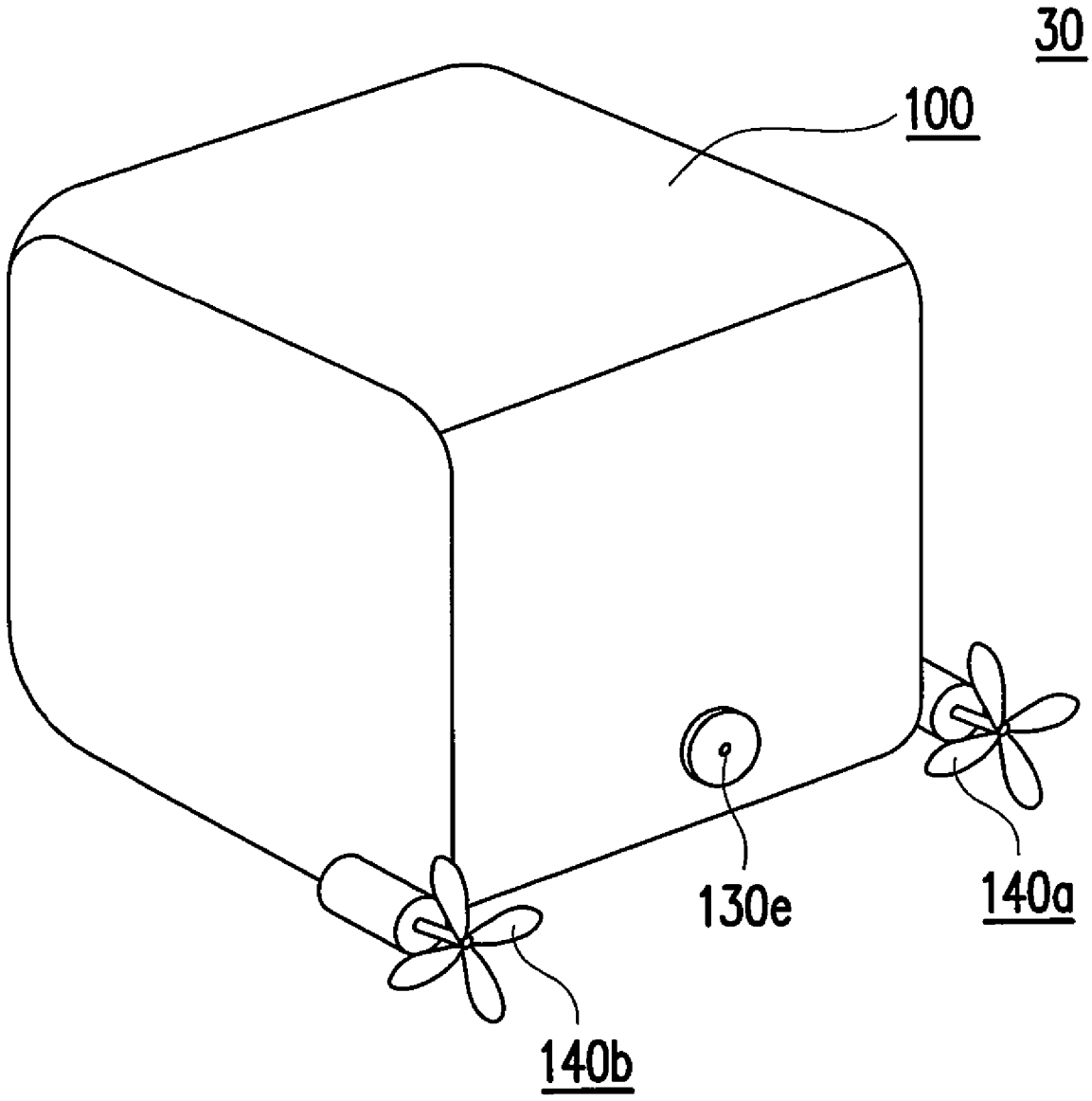
FIG. 2E is a schematic diagram of a diving device of a further embodiment of the present invention.

In an alternative embodiment, refer to FIG. 2E, which shows a schematic diagram of a diving device of a further embodiment of the present invention. The diving device 30 is similar to the diving device 10 as shown in FIGS. 2A~2C except that the left driving and right driving assemblies 140*a* and 140*b* are symmetrically disposed on a left side and a right side of the main body 100. By optionally activating the left driving assembly 140*a* and/or the right driving assembly 140*b*, the forward, backward, leftward and rightward moving forces are generated, whereby the diving device can move forward, backward, leftward or rightward to change the moving direction.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A diving device, comprising:

a sealed main body with at least one flexible portion disposed on at least one part of the main body; and an actuator, connected to the flexible portion, wherein the actuator is adapted for controlling a volume of the diving device by pulling or pushing the flexible portion inwards or outwards respectively through a transmission shaft, whereby a force is generated to drive the diving device moving in a vertical direction.

2. The diving device as claimed in claim 1, wherein the density of the diving device is sufficiently close to the density of material encompassing the diving device in an environment, which makes the diving device being able to be floating in any position of the environment.

3. The diving device as claimed in claim 1, further comprising a collision avoidance system comprising one or a plurality of sensors.

4. The diving device as claimed in claim 1, further comprising a left driving assembly and a right driving assembly, symmetrically disposed on the sealed main body, for respectively providing power to drive the diving device moving forward, backward, leftward or rightward.

5. The diving device as claimed in claim 4, wherein in the left driving assembly and right driving assembly, each of which includes a motor and a propeller driven by the motor.

6. A diving device, comprising:

a main body having at least one flexible portion, wherein the main body and the flexible portion together define a sealed space; and an actuator, accommodated in the sealed space and connected to the flexible portion, wherein the actuator is adapted to change a volume of the sealed space by pulling or pushing the flexible portion inwards or outwards respectively.

7. The diving device as claimed in claim 6, wherein the actuator is connected to the flexible portion by a transmission shaft, and the transmission shaft is adapted for pulling or pushing the flexible portion inwards or outwards respectively.

* * * * *